United States Patent [19]

Matoba

[11] Patent Number: 4,664,580

[45] Date of Patent: May 12, 1987

[54] MULTISTORY PARKING GARAGE

[75] Inventor: Nobuhito Matoba, Atlanta, Ga.

[73] Assignee: Matex Gear and Pump, Ga.

[21] Appl. No.: 766,185

[22] Filed: Aug. 16, 1985

[51] Int. Cl.[4] ..... E04H 6/12

[52] U.S. Cl. ..... 414/228; 187/8.41; 414/264

[58] Field of Search ..... 414/227, 228, 233, 242, 414/252–254, 264; 187/8.67, 8.41, 67, 95

[56] References Cited

U.S. PATENT DOCUMENTS

| | | | |
|---|---|---|---|
| 708,726 | 9/1902 | Miles | 187/67 |
| 1,803,583 | 5/1931 | Aitken | 414/227 X |
| 1,815,429 | 7/1931 | Canaday | 414/264 X |
| 2,948,421 | 8/1960 | Smith et al. | 414/264 |
| 2,994,445 | 8/1961 | Roth | 414/252 X |
| 3,260,353 | 7/1966 | Bajulaz | 414/254 X |
| 3,330,083 | 7/1967 | Jaulmes | 414/233 X |
| 3,618,793 | 11/1971 | Coursey | 414/233 |
| 4,264,257 | 4/1981 | Saurwein | 414/253 X |

FOREIGN PATENT DOCUMENTS

| | | | |
|---|---|---|---|
| 1129274 | 5/1962 | Fed. Rep. of Germany . | |
| 1193660 | 5/1965 | Fed. Rep. of Germany | 414/227 |
| 1585920 | 2/1970 | France . | |
| 616283 | 1/1961 | Italy | 414/227 |
| 627713 | 11/1961 | Italy | 414/227 |

*Primary Examiner*—Joseph E. Valenza
*Assistant Examiner*—David A. Bucci
*Attorney, Agent, or Firm*—David P. Kelley

[57] ABSTRACT

A multistory parking garage has a central core defined by four vertical columns, and a plurality of pairs of columns, each pair defining a plane parallel to the plane defined by pairs of vertical columns, defined bays containing vertically spaced parking cells, each cell adapted to hold two vehicles. An elevator is contrained to move only vertically within the central core, is enterable from any of four directions, and is capable of carrying two vehicles at a time, preferably in a nose to tail orientation.

4 Claims, 10 Drawing Figures

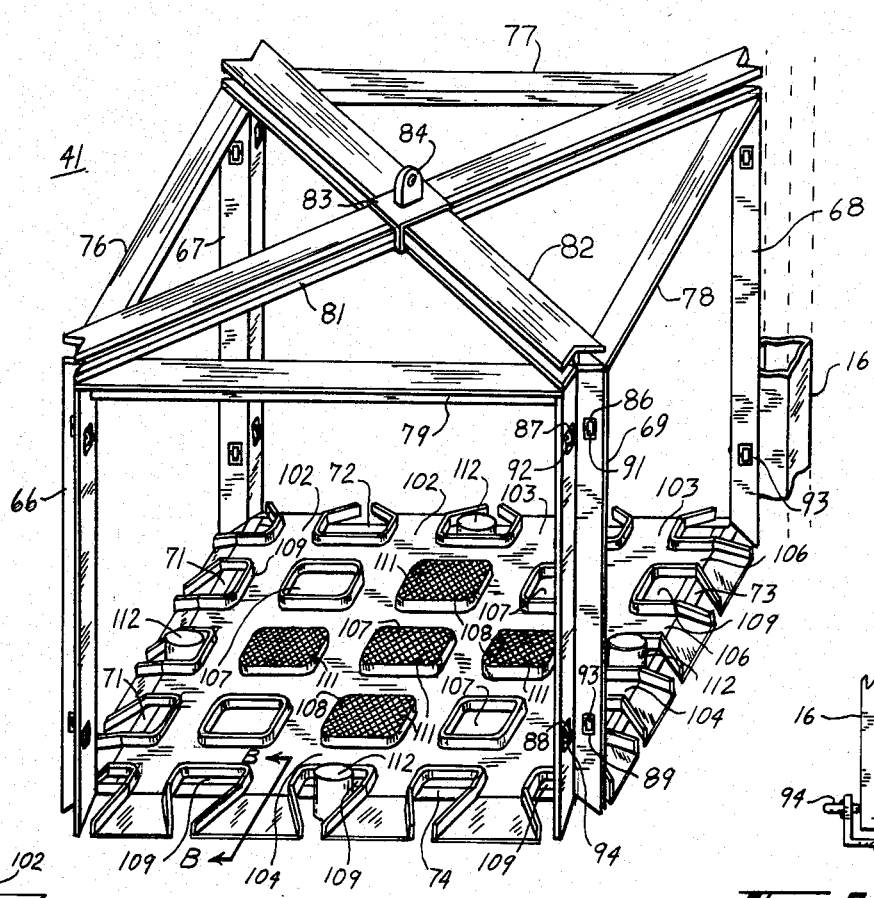
Fig 5
Fig 5A
Fig 5B
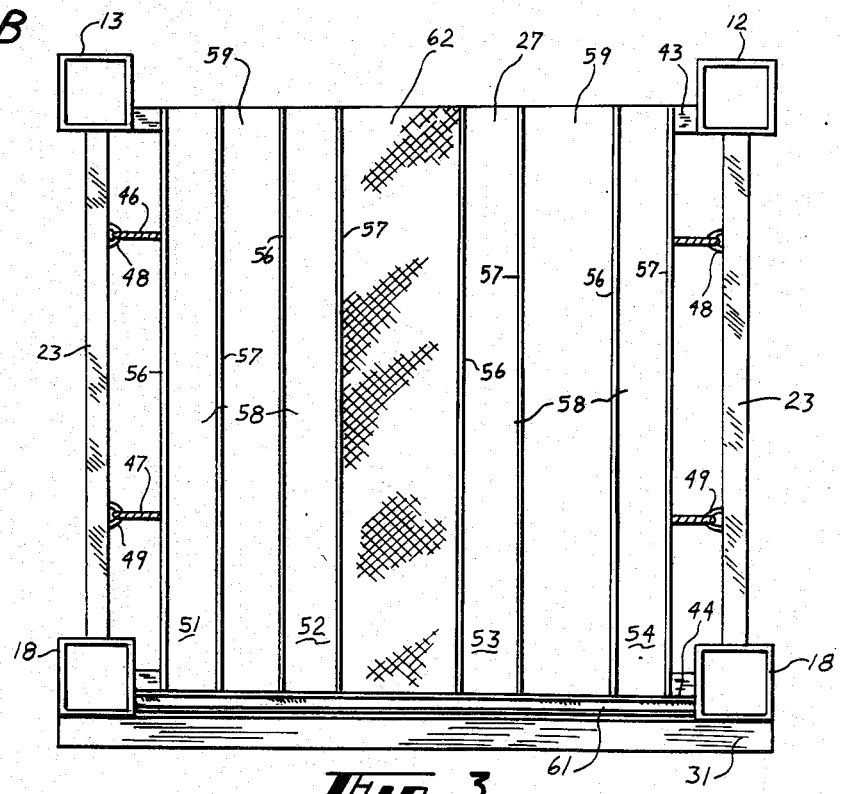
Fig 3

MULTISTORY PARKING GARAGE

BACKGROUND OF THE INVENTION

This invention relates to parking garages for automobiles and similar vehicles. More particularly, the invention relates to a multistory parking garage of such simple construction that it can be quickly assembled at a minimum expenditure of labor and money, and which occupies only a small area of ground.

With the growing commercialization of available land, especially in urban areas, and the attendant increase in land costs, the use of large areas of such land for parking automobiles is an uneconomical operation from the standpoint of monetary return, and yet the aforementioned commercialization has created an increasing demand for parking space. It is obvious, therefore, that a more economically desirable result can only be achieved through the use of multistory parking garages.

In the past there have been numerous designs of multistory parking garages. One such design is disclosed in U.S. Pat. No. 3,330,083 of E. Jaulmes, which discloses a multistory garage having first and second central portals which define a loading elevator shaft and third and fourth portals which define the outer limits of parking cells extending outward from two sides of the central shaft area. Each cell constitutes a floor pan for holding a vehicle, and all of such floor pans, each defining a parking cell, are suspended from suspension cables running from the top of the structure to the bottom thereof. Such a structure is, in some respects, more complex, especially in the use of cables, than is necessary for most uses. In addition, the risk of a cable failure is always present, and the failure of just one cable could be catastrophic, since large numbers of cells are held in place by such cable. In addition, the structure has numerous cells side-by-side on each level, necessitating the use of an elevator either moveable in a lateral direction or large enough to bring a vehicle in line with any given storage cell.

In U.S. Pat. No. 1,815,429 of J. L. Canady there is shown a parking garage having inner upright numbers forming an aisle for a vertically and horizontally moveable elevator, and outer uprights defining the outer ends of the parking stalls. Joists running between the inner and outer members support the pans which in turn support the vehicles, each pan supporting a single vehicle. Again, the parking cells extend outward from only two sides of the elevator shaft, since the elevator has to move horizontally to deliver vehicles to individual cells.

One multistory garage that does not use a horizontally moveable elevator and, as a consequence, has parking cells extending radially outward from the elevator shaft is shown in German patent No. 1,129,274 of Kann et al. This garage, while compressing the total area in which cars are stored by means of the radially extending parking cells, nevertheless relies on a complicated turntable elevator to bring each vehicle in line with a cell.

A multistory garage structure using conveyor belts to move the cars transversely from the elevator to the parking cell is shown in French patent No. 1,585,920. Such a structure is quite complicated and comparatively expensive.

In all of the foregoing designs, the elevator must be moveable in more than one direction, i.e., a direction other than the vertical, in order to place the vehicles in line with the parking cells, or, in the case of the French design, conveyor belts must be used between elevator and cell to accomplish the same end.

SUMMARY OF THE INVENTION

The present invention, through its unique and simple structure, eliminates most of the disadvantages characterizing prior art devices, and makes most efficient and economical use of the area available.

In one preferred embodiment of the invention, four steel box columns are arranged in a square configuration defining a central core which, in turn, defines an elevator shaft. Eight box columns are positioned in pairs to define four planes, each parallel to a plane of the square defined by the first four columns. Each pair of columns defines the outer ends of the parking cells, and they are joined to respective ones of the inner columns by a plurality of joists angled slightly upward from the outer columns to the inner columns. The joists define the floors or stories of the garage. Each pair of outer columns is joined by a plurality of steel beams, each beam being joined to the columns at points slightly above the juncture of each joist with the outer column. Each steel beam defines the outer end of a parking cell and, in addition to providing structural strength, acts as a barrier to any vehicles in the cell. Extending between the joists, each pair of which defines the sides of a cell are steel cables which function as supports for the floor of the cell. The floor itself is made of stamped or pressed steel forming a plurality of ridges running from front to back, and also defining guide means for the wheels of the vehicles. In addition to being supported by the cables, each floor is welded or otherwise attached to both the inner and outer columns. Each floor is designed with a pair of tracks, and it is one feature of the invention that each cell can contain two vehicles, parked facing in opposite directions so that the drivers' side of both vehicles is on the inside and reachable by an attendant from a walkway formed in the floor between the two vehicle tracks.

An elevator is located in the central core or shaft, and guide means on the elevator keeps it centered as it is raised or lowered. The floor of the elevator contains a first pair of vehicle tracks and a second pair at right angles thereto, so that vehicles can enter the elevator from any of the four sides of the square core. The elevator, which can carry two vehicles at a time, is adapted to travel only in the vertical direction, all of the parking cells being accessible to the elevator with only vertical movement thereof.

DESCRIPTION OF THE DRAWINGS

FIG. 3 is a plan view of a vehicle parking cell as used in the garage of FIG. 1;

FIG. 5 is a perspective view of the elevator for use in the garage of FIG. 1;

FIGS. 5A and 5B depict certain details of the elevator of FIG. 5;

DETAILED DESCRIPTION

Figure 2:
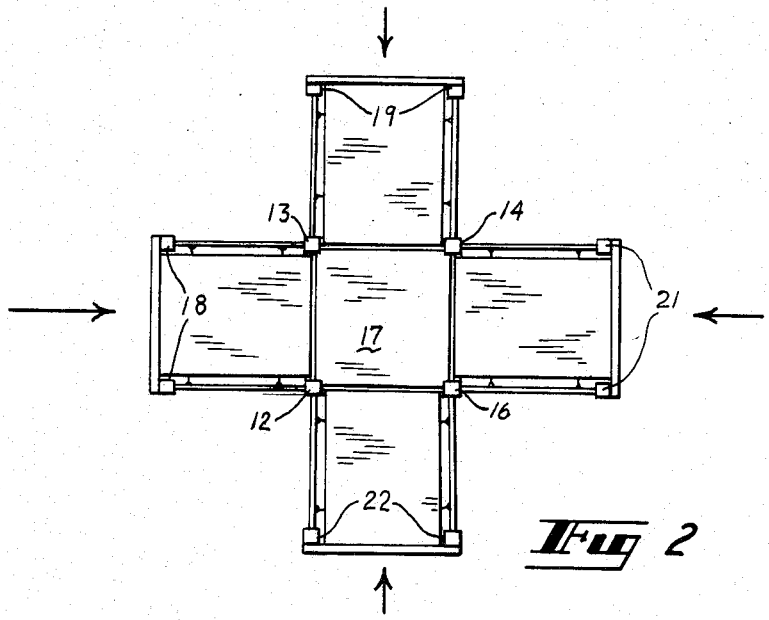
FIG. 2 is a plan view of the garage of FIG. 1.
Figure 1:
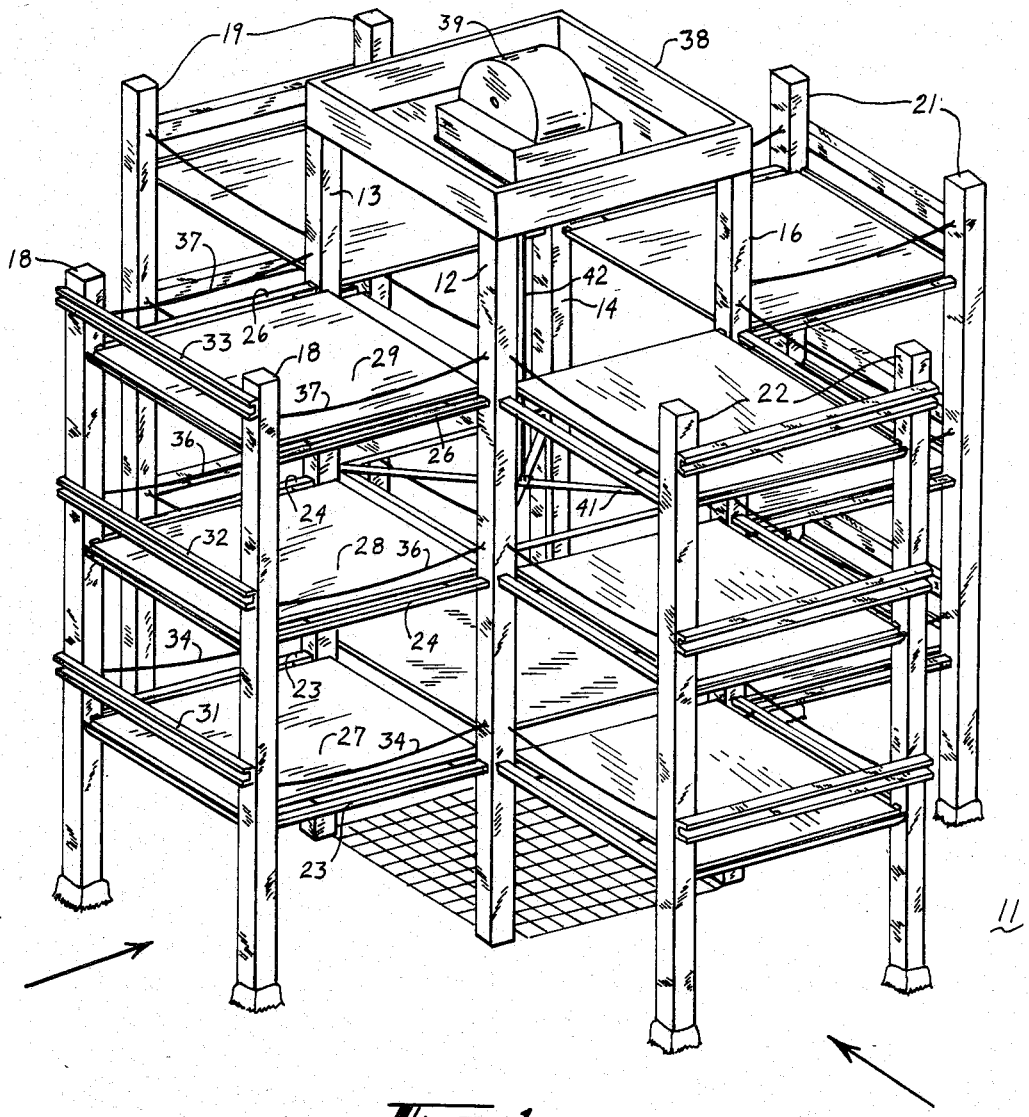
FIG. 1 is a perspective view of the multilevel parking garage of the present invention.

In FIG. 1 there is depicted a multistory parking garage 11 embodying the principles and features of the present invention. While the garage of FIG. 1 is shown as having only three parking levels, it is to be understood that the unique design permits several more parking levels, e.g., six, eight, or ten, depending upon the demand for parking in the particular locale. FIG. 2, which will be discussed concurrently with FIG. 1, shows a plan view of the structure of FIG. 1. The garage 11 comprises four inner pillars or columns 12, 13, 14, 16 formed of, for example, 10 in.×10 in.×1 in. structural steel box column. As can be seen in FIG. 2, the columns 12, 13, 14, 16 define a square inner core space 17 which, as will be discussed hereinafter, functions as an elevator shaft. First, second, third, and fourth pairs of box columns 18-18, 19-19, 21-21, and 22-22 are located remote from columns 12, 13, 14, and 16 and, as can be seen in FIG. 2, each pair of such columns defines an imaginary plane parallel to a corresponding side of the square formed by columns 12, 13, 14, and 16 thus producing a cruciform shape. The column pairs 18-18, 19-19, 21-21, and 22-22 are each located approximately twenty feet or slightly more from the inner columns. This distance is dictated by the maximum vehicle length to be encountered. At the present time the maximum for a standard passenger vehicle is slightly over nineteen feet, hence a minimum parking cell length would be twenty feet. This will be discussed more fully hereinafter. The columns thus far discussed are free standing, and at their lower ends are sunk into concrete, as illustrated in FIG. 1.

For simplicity, the remainder of the description of FIG. 1, as relates to the structure of the arms of the cruciform, will be limited to one such arm or bay, it being understood that the remaining three bays are identical. Each of the columns 18, 18 is joined as by welding to its corresponding inner column by a plurality of structural steel beams or joists 23-23, 24-24, and 26-26. The beams may be, for example, 6 in.×4 in.×$\frac{3}{4}$ in. C-channel steel. Beams 23, 23 are located approximately ten feet from the ground, while the vertical spacing between beams 23 and 24, and 24 and 26, may be between five and six feet. Although it is not readily discernible from the drawings, each of the beams 23, 24 and 26 slopes slightly downward from the inner columns 12, 13 to the outer columns 18, 18.

Supported by the beams 23-23, 24-24, and 26-26 are floor pans 27, 28, and 29 respectively, which will be discussed in detail hereinafter in connection with FIGS. 3 and 4. The floor pans are the supports for the parked vehicles, and each pan with its supporting structure defines a parking cell. Extending between columns 18, 18 and attached thereto, as by welding, are barriers 31, 32, and 33, each barrier being located slightly above (at approximately automobile bumper height) its corresponding floor pan. Barriers 31, 32, and 33 perform the dual function of containing the vehicles and adding strength and rigidity to the ovrall structure. These barriers may be made, for example, from 6 in.×4 in.×$\frac{3}{4}$ in. C-channel steel. The inner surface of the barriers may be covered with cushioning material to protect the vehicles. Strung between the inner columns 12, 13 and the outer columns 18, 18 are cables 34, 36, and 37 whose primary function is to protect any personnel who may be in one of the parking cells.

As can be seen in FIG. 1, inner columns 12, 13, 14, and 16 extend above outer columns 18-18, 19-19, 21-21, and 22-22. At the top of columns 12, 13, 14, and 16 is a machinery cell 38 which contains the necessary motors and machinery, shown schematically as 39, for raising and lowering an elevator 41 by means of elevator suspension means 42, shown schematically as a cable. In addition, if elevator counter weights are required they may be strung down the outside of the structure in any suitable manner, not shown.

In FIGS. 1 and 2, it can be seen that the garage can be approached from four directions. It can also be seen that the actual structure occupies very little area on the ground, taking up the space that would normally be occupied by approximately sixteen standard size vehicles.

Figure 4:
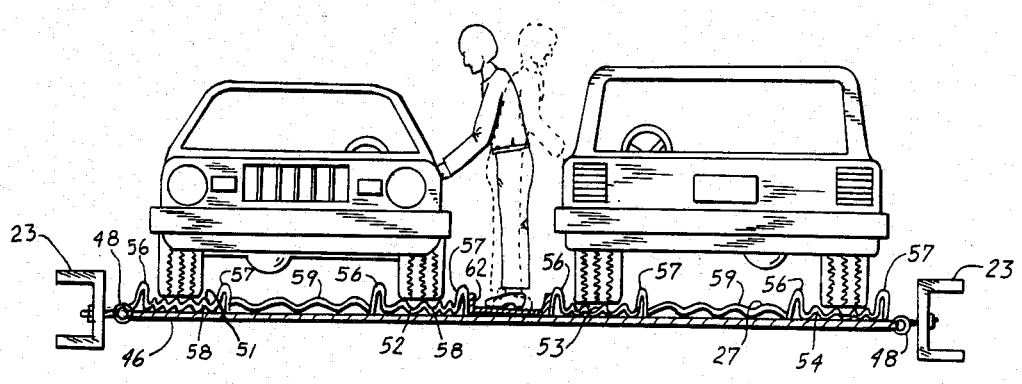
FIG. 4 is an elevation view of a portion of the parking cell of FIG. 3.

FIG. 3 is a plan view of a typical storage or parking cell, while FIG. 4 is an elevation view of the floor 27 of FIG. 3. As can be seen in FIG. 3, floor 27 is supported at its inner and outer ends by suitable structural support members 43 and 44, which may take the form of L-shaped angle "iron", made of structural steel of approximately 4 in.×6 in.×$\frac{3}{4}$ in., and welded to columns 12 and 13 and to columns 18, 18 respectively. The floor pan 27 is welded or riveted or otherwise firmly attached to the members 43 and 44. Floor pan 27 is also supported by means of wire rope or cable members 46 and 47 which are attached to members 23,23 by suitable attaching means 48, 49 respectively, shown in the figure as eye bolts. Members 46 and 47 may be of any suitable cable size sufficient to support the weight of two vehicles. Approximately $\frac{3}{4}$ in. stranded cable or wire rope may be used, for example.

Referring now to both FIGS. 3 and 4, the floor pan 27 is built up from several component parts. Pan 27 consists of four wheel guides 51, 52, 53, and 54, which may be rolled or stamped from, for example, 5 mm thick high strength low carbon steel. Each wheel guide comprises a pair of flanges 56, 57 joined by a corrugated portion 58, and the innermost flanges of each pair of wheel guides (51, 52 and 53, 54) are jointed as by welding by a corrugated member 59 which may be, for example, of 2 mm thick high strength low carbon steel, welded to the flanges. Since member 59 is not a load bearing member, the strength requirements on it are not so great. The corrugated portion 58 has, as can be seen in FIG. 4, variable corrugation widths. Wider corrugations are on the inner portion of the guide where normally smaller car wheels will track and narrower corrugations are on the outer portion of the guide where the wheels of larger cars will track. The corrugations run the entire length of the floor pan, and the width variations in conjunction with the flanges 56, 57 insure straight line tracking of the vehicle wheels. It is necessary that flanges 56, 57 be high enough to prevent the vehicle wheels from riding up over them. A height of approximately 6 in. is adequate for this purpose.

The corrugated web 59 functions as both a strength member and an oil drip catcher, and, since the floor pan is angled slightly downward, any fluid dripping will flow to the outer end of the pan where it can be collected by a suitable channel member 61 of any suitable material. The drippings thus collected may be drained off by any suitable means, not shown.

The two innermost guides 52, 53 are joined by a web 62 of metal grating approximately 2 to 3 mm thick which is welded or otherwise joined to the two innermost flanges 56, 57. Web 62 may be formed of expanded steel mesh, and must be of sufficient load bearing capability to support one or two parking attendants. The structure of the floor pan, as just described, is strong and relatively light weight. The use of corrugations increases the strength to weight ratio, and the various components of the floor may be pre-fabricated and assembled at the garage building site.

In FIGS. 5, 5A, and 5B there is depicted the structure of the elevator cage and, in particular, the floor thereof. Elevator 41 comprises four corner posts 66, 67, 68, 69 defining a square and formed of, for example, 6 in.×6 in.×½ in. L-shaped angle "iron" made of structural steel. Each post is oriented so that the angle opens outward, as shown. Posts 66 and 67 are joined as by welding at the bottom by a length of angle iron (steel) 71, posts 67 and 68 by a length 72, posts 68 and 69 by a length 73, and posts 69 and 66 by a length 74. Lengths 71, 72, 73, and 74 also function as support members for the elevator floor. In a like manner, posts 66 and 67 are joined at the top by members 76, posts 67 and 68 by member 77, posts 68 and 69 by members 78, and posts 69 and 66 by member 79. The net result is a rigid and extremely strong elevator cage. The cage is further strengthened at the top by bracing members 81 and 82, formed, for example, by structural I-beams, and welded or otherwise joined at the four corners of the cage. At the corner of the X thus formed, the members 81 and 82 are joined, as by welding, and the junction is further strengthened by plate 83 which is firmly affixed to the junction. Attached to plate 83 is a member 84 to which the elevator cable 42 is attached. It is to be understood that the means of connecting cable 42 to the elevator is in accordance with best practices, and member 84 is merely a representation of such connecting means. Likewise, cable 42 is such a representation, inasmuch as sound practice may dictate the use of several cables, for example.

As can be seen in FIG. 5, each of posts 66, 67, 68 and 69 has a slot in each arm of the L at the upper end 86, 87, and a slot in each arm of the L 88, 89 toward the lower end. Extending through said slots 86, 87, 88, 89 are guide wheels 91, 92, 93, 94 mounted on axles affixed to the back sides of each arm of the L as best seen in FIG. 5A. The guide wheels are adapted to ride against columns 12, 13, 14, and 16 to hold the elevator 41 in relatively fixed lateral relationship to the columns while permitting vertical movement of the elevator. The wheels may be rubber-tired and, if desired, spring loaded to obviate possible jamming that could occur with rigidly fixed wheels. Members 81 and 82 are notched at their outer ends, as shown, to provide clearance for the columns 12, 13, 14, and 16 so that elevator 41 can move freely up and down.

The floor of elevator 41 is designed to rest upon and be affixed to members 71, 72, 73, and 74. The floor comprises first and second pairs 102, 102 and 103, 103 of walled or flanged tire guides. The floor further comprises third and fourth pairs 104, 104 and 106, 106 of walled or flanged tire guides oriented at right angles to the first and second pairs of guides. The tire guides may be built up from one inch C-channel steel, for example, and cut and welded to the other tire guides at their intersections. The flanges are also cut at the intersections, thereby creating a plurality of walled open spaces 107, 107, 108, 108, and 109, 109. To avoid possible damage to vehicle tires, the corners of the walls of the open spaces are rounded, as shown. Open spaces 108, 108 have mounted on and affixed to the walls thereof expanded steel grating members 111, 111 for supporting the parking attendants, as does the central open space 107, as shown. Centrally located on each side of the elevator floor, and mounted within the central space 109 are shock absorbers, 112, 112 for cushioning the elevator as it reaches ground level. Shock absorbers 112, 112 may take any of a number of forms, such as oiled filled piston and cylinder, or heavy duty springs.

Figure 6:
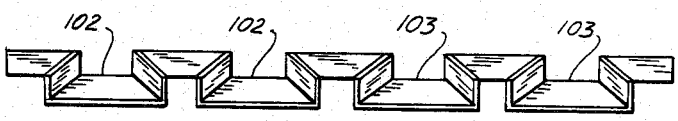
FIG. 6 is a view of a portion of the floor of the elevator of FIG. 4.

To facilitate ingress and egress of vehicles to and from the elevator, the ends of the tire guides 102, 103, 104, and 106 are flared and sloped downward, as best seen in FIG. 5B, which is a cross section along the line B—B of FIG. 5, and in FIG. 6. The flaring of the flanges insures proper centering within the tire guides of the vehicles as it is driven onto the elevator, and the sloping eliminates bumps and insures a smooth transition between the ground and the elevator, as well as between the elevator and each parking cell.

In the operation of the garage, vehicles may approach the elevator from any one of four directions, as best seen in FIG. 2. The elevator holds two cars at a time, which are driven onto it from opposite directions, thus insuring that the driver's side is to the inside of the elevator. Thus at no time do the attendants enter or leave the vehicles from the outer sides of the elevator. In like manner, when the elevator reaches the desired storage cell, one vehicle is driven forward into the cell, while the other is backed into the cell, thus assuring that both attendants enter and leave the vehicles from the central grid 62 of the cell. The unique design of the elevator and the parking cells makes this possible, and guarantees the safety of the attendants.

Figure 7A:
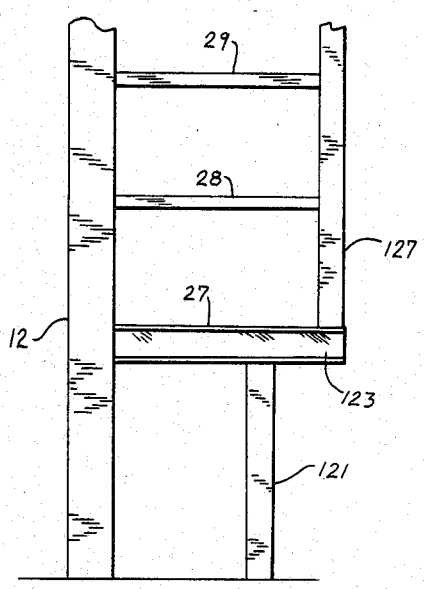
FIG. 7A and 7B are partial views of a variation of the structure of the garage of FIG. 1.
Figure 7B:
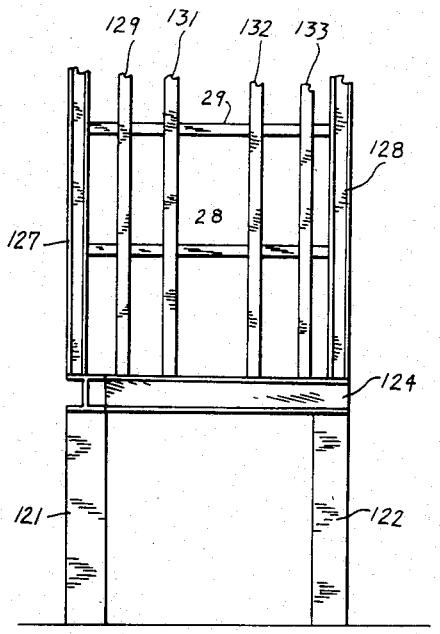

In FIGS. 7A and 7B there is shown a variation of the columnar arrangement of the garage which permits vehicles to make sharper turns in entering the garage, thus saving ground space. The arrangement of FIGS. 7A and 7B comprises columnar members 121 and 122 spaced from the inner columns, only column 12 being shown, a distance about two-thirds of the length of a parking cell. Members 121 and 122 support structural beam members 123, 124 which may be, for example, heavy duty, i.e., 12 inch, I-beam members welded together and to the inner columns. Members 123, 124 define the first parking level designated by floor pan 27.

Extending vertically upward from members 123 and 124 are vertical members 127 and 128, which may be, for example, 6 inch I-beams. Members 127 and 128 form the outer supports for each of the parking cells. Between members 127 and 128 are a plurality of spaced vertical members 129, 131, 132 and 133 which also function as supports. In addition, members 129, 131, 132 and 133 also function as stops for the vehicles in the parking cells. To this end, their inner surfaces may be covered with a cushioning material.

It can be seen that the variation shown in FIGS. 7A and 7B occupies less ground space and permits sharper turns than the arrangement of FIG. 1.

It is readily apparent from the foregoing that the invention comprises a simple, economical parking garage utilizing a minimum of space and which may be quickly erected utilizing standard, readily available materials. While the foregoing illustrative embodiments of the invention represented preferred forms thereof, various modifications and changes may occur to persons skilled in the art without departure from the spirit and scope of the invention.

I claim:

1. A multistory parking garage comprising first, second, third and fourth vertical columns forming an open square, a plurality of pairs of columns spaced from said vertical columns, each of said pairs of columns defining a plane oriented parallel to one of the sides of the square formed by said vertical columns, means for producing, in conjunction with said pairs of columns, a cruciform shaped garage, said means comprising a plurality of vertically spaced pairs of joists extending from each of said pairs of columns to the corresponding vertical columns, each arm of the cruciform shape comprising a parking bay, a plurality of members defining, in conjunction with each of said pairs of joists, a plurality of fixed parking cells within each of said bays, said members defining the outer limits of said parking cells, a fixed vehicle supporting floor pan for each of the parking cells, each said floor pan being adapted to hold two vehicles by means of pairs of wheel guides extending between the inner vertical columns and the corresponding pair of outer columns, support means within each cell for supporting the floor pan, said support means including members extending between the pairs of joists defining the parking cell intermediate the ends thereof, means for providing access to vehicles within each of said cells comprising a load bearing surface extending between the innermost wheel guides; and means providing vehicle access to each of said bays and to each of said parking cells within said bays comprising an elevator, means for raising and lowering said elevator within the vertical space formed by said vertical columns, means including said vertical columns for limiting the movement of said elevator to vertical movement only, said elevator having a fixed vehicle bearing floor, said floor having first and second parallel pairs of flanged wheel guides extending across said floor in one direction, and third and fourth parallel pairs of flanged wheel guides extending across said floor in a direction at right angles to said one direction, whereby pairs of vehicles may be given simultaneous access to any cell solely through vertical movement of said elevator.

2. A multistory parking garage as claimed in claim 1 wherein each of said pairs of columns spaced from said vertical columns is supported by structural beam members, said structural beam members being supported by columnar members spaced from said vertical columns a distance less than the spacing of said pairs of columns from said vertical columns.

3. A multistory parking garage as claimed in claim 1 wherein the support means within each cell comprises a support member extending between the two columns forming a pair, a support member extending between the corresponding two vertical columns, and the said members extending between the pairs of joists intermediate the ends thereof comprise a pair of horizontal cable members upon which said floor pan rests.

4. A multistory parking garage as claimed in claim 1 wherein the flanges at the ends of said wheel guides in the elevator floor are flared outward and the ends of said guides are angled downward to form vehicle entrance and exit ramps; the intersection of said first and second wheel guide pairs with said third and fourth wheel guide pairs creating a plurality of walled open spaces, and grating means covering the walled open spaces between the pairs of wheel guides.

* * * * *